United States Patent [19]

Tetrault

[11] Patent Number: 5,044,040

[45] Date of Patent: Sep. 3, 1991

[54] TOILETTING ASSIST DEVICE

[76] Inventor: Lise Tetrault, 213 Belle Isle Ct., Naples, Fla. 33962

[21] Appl. No.: 524,549

[22] Filed: May 17, 1990

[51] Int. Cl.[5] ..... A47K 7/08

[52] U.S. Cl. ..... 15/210 R; 15/143 R; 15/209 R; 15/231; 604/1

[58] Field of Search ..... 15/209 R, 209 D, 210 A, 15/210 R, 211, 220 R, 225, 231, 232, 143 R, 147 R, 244.1; 128/67; 604/1, 11, 47, 286, 289, 309

[56] References Cited

U.S. PATENT DOCUMENTS

| | | | |
|---|---|---|---|
| 2,159,295 | 5/1939 | Seifert | 15/244.1 |
| 2,491,274 | 12/1949 | McNeill | 15/244.1 X |
| 2,635,274 | 4/1953 | Hatcher et al. | 15/147 R UX |
| 2,679,064 | 5/1954 | Palma, Jr. et al. | 15/244.1 |
| 2,814,817 | 12/1957 | Ducker | 15/244.1 X |
| 2,816,313 | 12/1957 | Beck et al. | 15/210 R UX |
| 2,825,084 | 3/1958 | Sanborn | 15/210 R |
| 2,998,614 | 9/1961 | Winch | 15/210 R UX |
| 3,225,375 | 12/1965 | Atkinson et al. | 15/210 R |
| 3,228,398 | 1/1966 | Leonard et al. | 15/244.1 X |
| 3,332,103 | 7/1967 | Case | 15/210 R UX |

FOREIGN PATENT DOCUMENTS

| | | | |
|---|---|---|---|
| 0329938 | 8/1989 | European Pat. Off. | 15/160 |
| 3333235 | 3/1985 | Fed. Rep. of Germany | 15/209 R |

*Primary Examiner*—Harvey C. Hornsby
*Assistant Examiner*—C. E. Cooley
*Attorney, Agent, or Firm*—Brady, O'Boyle & Gates

[57] ABSTRACT

A toiletting assist device for a patient wearing a back brace or having other body limitations causing inability to reach sufficiently to perform the toiletting function, including a base member upon which a removable cleansing fabric is wrapped and an integral handle extending at an obtuse angle from one end of the base member. The length of the handle and the angle thereof relative to the base member are such that the patient, while sitting on a toilet, can reach the anatomical areas to be wiped without bending or moving the torso laterally.

6 Claims, 1 Drawing Sheet

FIG. 1
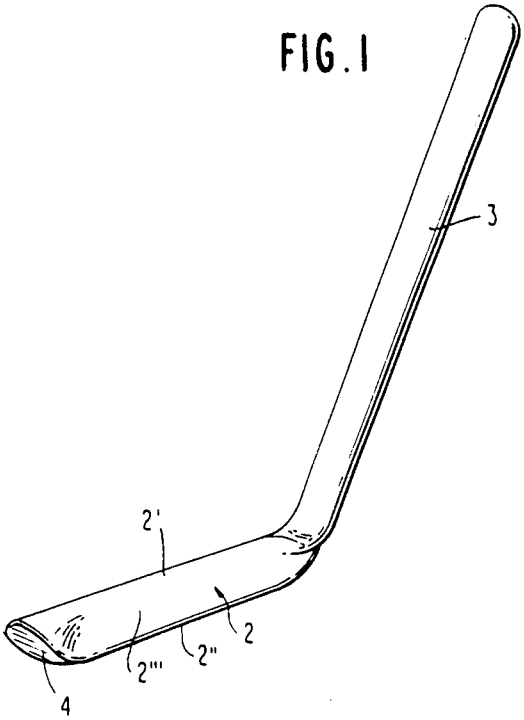
FIG. 2
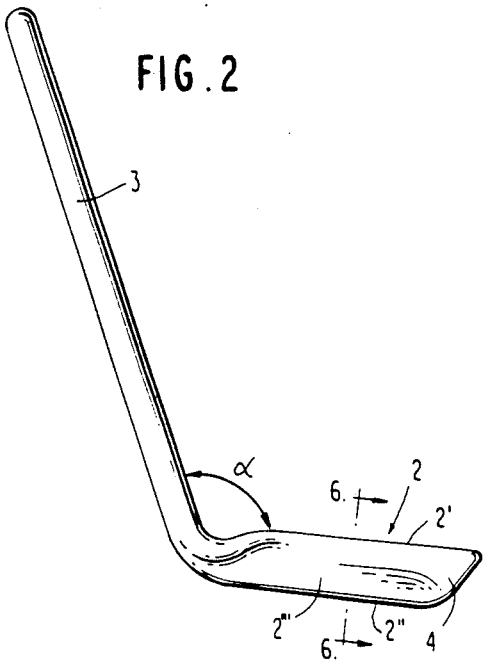
FIG. 3
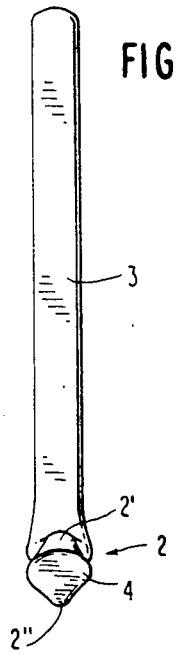
FIG. 4
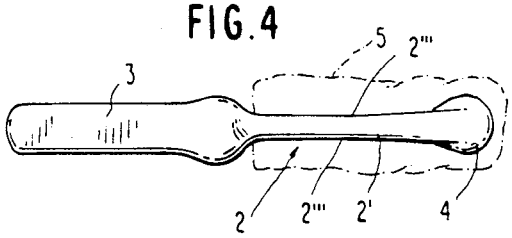
FIG. 6
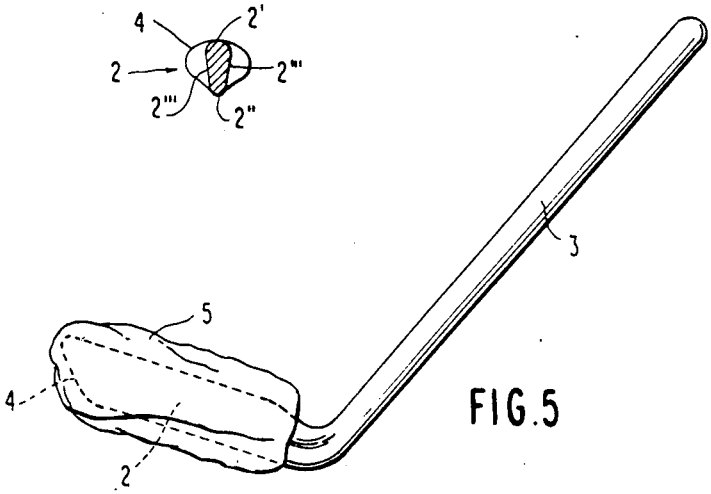
FIG. 5

TOILETTING ASSIST DEVICE

BACKGROUND OF THE INVENTION

Patients recovering from back surgery, such as laminectomy for removal of tumors from the spinal cord, for injuries to the spinal cord, for removal of a dislocated spinal disk, etc., discectomy; spinal fusion; insertion of metal fixators, such as Harrington rods; and the like, are often required to wear a body brace extending from the neck to the buttocks, to either immobilize or restrict the movement of the patient's torso during the recuperation period. While the patient has to become resigned to the reality of wearing the back brace and its concomitant restriction to relatively simple body movements, such as, standing, walking and sitting, the patient also has to accept the restriction of other body movements; such as, bending, twisting of the trunk of the body, and/or moving the trunk or back laterally while sitting. This is particularly evident when the patient is sitting on a toilet and attempts to cleanse himself/of herself after urinating and/or defecating. Obese individuals as well as individuals who have a limited range of shoulder, elbow, wrist and/or hand grasp movement, also have problems with toiletting.

SUMMARY OF THE INVENTION

After considerable research and experimentation, the device of the present invention has been devised to assist such a patient in performing the toiletting function required for maintaining the patient's personal hygiene, and comprises essentially, a base or foot member having an integral handle extending from one end of the base member at an obtuse angle of approximately 110° to 120°, preferably, 115°, the free end of the base member having an enlarged portion. By the construction and arrangement of the handle and base member, toilet paper can be loosely wrapped around the base member, and the patient can hold the handle and perform the toiletting function while not bending or moving the torso laterally, since the device provides that extra needed reach without such movements, and also when the range of motion of other joints is limited.

BRIEF DESCRIPTION OF THE DRAWINGS

FIG. 1 is a perspective view of the device of the present invention;

FIG. 2 is a side elevational view of the device;

FIG. 3 is an end elevational view of the device;

FIG. 4 is a top plan view of the device showing, in phantom, toilet paper mounted on the base member;

FIG. 5 is a side elevational view of the device as shown in FIG. 4, showing toilet paper or a wash cloth wrapped around the base member, and FIG. 6 is a cross-sectional view taken on line 6—6 of FIG. 2.

DESCRIPTION OF THE PREFERRED EMBODIMENT

Referring to the drawings, and more particularly to FIGS. 1 and 2 thereof, the device 1 of the present invention comprises a base or foot member 2 having a handle 3 integrally connected to one end thereof. The handle 3 extends from the base member at an obtuse angle $\alpha$ which is in the range of 110° to 120°, preferably 115°. The top and bottom surfaces of the handle 3 are greater in width than its thickness, and the handle is greater in width than the width of the base member 2. As shown in FIGS. 2–4, the base member 2 has a relatively narrow rounded top portion 2′ that is greater in width than the bottom edge portion 2″ thereof, and has side portions 2‴ extending between the top and bottom portions that are substantially greater in height or vertical dimension than the width of the rounded top portion.

As will be seen in FIGS. 3 and 4, the free end of the base member 2 is provided with an enlarged end portion 4, and a cleansing fabric 5, such as toilet tissue or a wash cloth, is wrapped around the base member 2. The enlarged free end portion is preferably formed by the side portions of the base member 2 being outwardly flared at the free end. The enlarged free end portion has a smooth top portion in coplanar alignment with the top of the rest of the base member 2. The enlarged free end portion 4 engages the interior of the fabric to prevent the fabric from sliding off the base member 2 while the device is being used.

In use, the patient wraps the toilet tissue or washcloth loosely around the base member 2, and while holding the handle 3 adjacent the upper free end thereof, the base member 2, and associated wiping fabric, is extended to the anal and/or vaginal areas. The length of the handle 3 and angle of disposition relative to the base member 2 are such that the patient is provided that extra needed reach, and can reach the area to be wiped from either the front or back without bending the torso or moving the torso laterally. After use, the toilet tissue is easily disposed of in the toilet by slipping it off the free end of the base member.

The device can be of molded plastic with the handle having a length of approximately 6″, and the base member having a length of approximately 3″. The cleansing fabric can be easily removed from the base member and either disposed of in the toilet or washed for future use.

The terms and expressions which have been employed herein are used as terms of description and not of limitation, and there is no intention, in the use of such terms and expressions, of excluding any equivalents of the features shown and described or portions thereof, but it is recognized that various modifications are possible within the scope of the invention claimed.

I claim:

1. A toiletting assist device for a patient having a body limitation causing inability to reach sufficiently for toiletting, comprising, a base member, a handle integrally connected to one end of said base member, said handle having a predetermined length extending at an obtuse angle from the base member, said base member being relatively narrow in width to enable it to fit between the buttocks of a patient, and having a rounded top portion, a bottom edge portion, and side portions extending downwardly from said rounded top portion to said bottom edge portion, said downwardly extending side portions having a height substantially greater than the relatively narrow width of said rounded top portion, a removable cleansing fabric wrapped around the base member, said downwardly extending side portions terminating in an outwardly flared enlarged portion on the free end of said base member for holding the cleaning fabric thereon, said enlarged portion has a smooth top portion in coplanar alignment with said rounded top portion, whereby the length of the handle and the angle thereof relative to the base member are such that the patient, while sitting on a toilet, can reach the anatomical areas to be wiped without bending or moving the torso laterally.

2. A toiletting assist device according to claim 1, wherein the obtuse angle is in the range between 110° and 120°.

3. A toiletting assist device according to claim 1, wherein the length of the handle is approximately six inches.

4. A toiletting assist device according to claim 1, wherein the base member and integral handle are of molded plastic.

5. A toiletting assist device according to claim 1, in which said handle is greater in width than the width of said base member.

6. A toiletting assist device according to claim 5, in which said handle has top and bottom surfaces greater in width than the thickness of said handle.

* * * * *